US008693939B2

(12) United States Patent
Tomono et al.

(10) Patent No.: US 8,693,939 B2
(45) Date of Patent: Apr. 8, 2014

(54) FIXING DEVICE AND IMAGE FORMING APPARATUS HAVING AN ANTI-TACK AGENT APPLICATOR

(75) Inventors: Hidenori Tomono, Kanagawa (JP); Yasuo Katano, Kanagawa (JP); Yukimichi Someya, Saitama (JP); Tsuneo Kurotori, Tokyo (JP); Yuko Arizumi, Kanagawa (JP); Shigenobu Hirano, Kanagawa (JP); Hidekazu Yaginuma, Kanagawa (JP); Shigeo Takeuchi, Kanagawa (JP); Fuminari Kaneko, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 624 days.

(21) Appl. No.: 12/929,249

(22) Filed: Jan. 11, 2011

(65) Prior Publication Data

US 2011/0217098 A1 Sep. 8, 2011

(30) Foreign Application Priority Data

Mar. 4, 2010 (JP) ..... 2010-047938
Oct. 25, 2010 (JP) ..... 2010-238727

(51) Int. Cl.
*G03G 15/20* (2006.01)

(52) U.S. Cl.
USPC ..... 399/340; 399/325

(58) Field of Classification Search
USPC ..... 399/340, 341, 324, 325
See application file for complete search history.

(56) References Cited

U.S. PATENT DOCUMENTS

| | | | |
|---|---|---|---|
| 7,655,374 | B2 | 2/2010 | Katano et al. |
| 7,713,673 | B2 | 5/2010 | Katano et al. |
| 7,773,932 | B2 | 8/2010 | Katano et al. |
| 2003/0005945 | A1 * | 1/2003 | Onishi et al. |
| 2006/0133866 | A1 | 6/2006 | Asakura et al. |
| 2006/0263712 | A1 | 11/2006 | Katano et al. |
| 2007/0243483 | A1 | 10/2007 | Katano et al. |
| 2008/0063446 | A1 | 3/2008 | Katano et al. |
| 2008/0069612 | A1 | 3/2008 | Nakamura et al. |
| 2008/0213002 | A1 | 9/2008 | Katano et al. |
| 2009/0003903 | A1 | 1/2009 | Katano et al. |
| 2009/0067904 | A1 | 3/2009 | Katano et al. |
| 2011/0183254 | A1 * | 7/2011 | Shoshi et al. |

FOREIGN PATENT DOCUMENTS

| | | |
|---|---|---|
| CN | 1786848 | 6/2006 |
| JP | 2007219105 A | 8/2007 |
| JP | 2008102300 A | 5/2008 |
| JP | 2010210976 A | 9/2010 |

OTHER PUBLICATIONS

Chinese Office Action and English translation thereof dated Mar. 27, 2013.

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

A disclosed fixing device includes a fixer application unit configured to apply a fixer containing a softener, capable of softening resin by dissolving or swelling at least a part of the resin, and water to resin particles formed on a recording medium such that the resin particles are fixed on the recording medium. The fixing unit may further include an anti-tack agent application unit configured to apply a liquid anti-tack agent immiscible with the softener to surfaces of the resin particles that are mixed with the softener by the application of the fixer containing the softener.

4 Claims, 5 Drawing Sheets

FIXING DEVICE AND IMAGE FORMING APPARATUS HAVING AN ANTI-TACK AGENT APPLICATOR

BACKGROUND OF THE INVENTION

1. Field of the Invention

The present invention relates to a fixing device and an image forming apparatus having such a fixing device.

2. Description of the Related Art

Image forming apparatuses such as a printer, a facsimile machine, a photocopier, and a multifunctional peripheral having these functions are generally configured to form images including characters or symbols on recording media such as paper, cloth, and OHP sheets based on image information. In particular, electrophotographic image forming apparatuses are widely used for forming high definition images composed of resin particles on plain paper at high speeds. Note that the resin particles indicate particles containing resin as one of their components. Toner has particles specifically used in the electrophotographic image forming apparatuses. Toner contains materials to generate necessary functions for forming images by the electrophotographic image forming apparatuses, such as a charge control agent to generate an electrostatic property in the resin particles, a coloring material to generate colors, and a material to prevent the particles from binding. In the electrophotographic image forming apparatus, a fixing speed is high and the quality of the fixed image is generally high. Thus, a thermal fixing system is widely used in the electrophotographic image forming apparatus. In the thermal fixing system, toner residing on a recording medium is melted, and pressure is applied to the melted toner on the medium, thereby fixing the toner on the recording medium. However, in the electrophotographic image forming apparatus having the thermal fixing system, more than half of the power is consumed for heating the toner, which makes it difficult to achieve energy savings technology in the electrophotographic image forming apparatus.

In view of recent environmental concerns, the development of a low power consumption (energy-saving) fixing device has been desired. That is, a fixing device having a non-thermal fixing system (hereinafter also called a "non-thermal fixing device") capable of fixing toner on the recording medium without heating has been desired. An example of such a non-thermal fixing system is disclosed in Japanese Patent Application Publication No. 2007-219105 (hereinafter referred to as "Patent Document 1"). Patent Document 1 discloses a wet fixing system in which a fixer (liquid fixer) is generated in a foam state and the generated foam fixer is applied onto resin particles on a recording medium while controlling a film thickness of the foam fixer, thereby fixing resin particles on the recording medium. Note that there are numerous types of softeners used in this system, an example of which include aliphatic ester disclosed in Japanese Patent Application Publication No. 2008-102300 (hereinafter referred to as "Patent Document 2"). However, non-volatile softeners may be preferable in view of an environmental problem for volatile organic compounds or adverse effect of the softener on the human body. Note that Patent Document 1 also discloses a fixing device in which a fixer containing a softener to soften resin particles by melting or swelling at least part of the resin is applied to the resin particles residing on the recording medium to thereby fix the resin particles on the recording medium. The fixing device disclosed in Patent Document 1 includes a foam fixer generator unit configured to generate a fixer in a foam state, a film thickness control unit configured to control a film thickness of the generated fixer in the foam state, and an application unit configured to apply the generated fixer in the foam state to the resin particles residing on the recording medium. Moreover, Patent Document 2 discloses a fixing method in which are applied a fixer containing a softener to soften resin by melting or swelling at least part of the resin to resin particles and a component for controlling the softening of the resin by allowing the softener to react with the fixer.

However, in the wet fixing method disclosed in Patent Document 1, if a non-volatile softener is used in particular, the softener remains in the toner and the toner thus remains soft after the toner is being fixed on the recording medium. Accordingly, the image formed on the recording medium may have tackiness (i.e., instantaneous tackiness). With this method, if two or more recording media such as paper on which images are correspondingly formed are mutually stacked, an image bleed-through or strike-through may occur, or missing images in the media due to the bleed-through or strike-through may occur.

SUMMARY OF THE INVENTION

It is a general object of embodiments of the present invention to provide a fixing device capable of preventing an image forming area of the recording medium from having image bleed-through or strike-through, or missing images due to tackiness to improve image stability and long-term image preservation after the image has been fixed on the recording medium; and an image forming apparatus having such a fixing device that substantially eliminates one or more problems caused by the limitations and disadvantages of the related art.

In one embodiment, there is provided a fixing device that includes a fixer application unit configured to apply a fixer containing a softener, capable of softening resin by dissolving or swelling at least a part of the resin, and water to resin particles formed on a recording medium such that the resin particles are fixed on the recording medium; and an anti-tack agent application unit configured to apply a liquid anti-tack agent immiscible with the softener to surfaces of the resin particles that are mixed with the softener by the application of the fixer containing the softener.

In another embodiment, there is provided an image forming apparatus that includes a latent image forming unit configured to form a latent image on a latent image carrier; an image forming unit configured to develop the latent image formed on the latent image carrier using a developer containing resin particles to form an image composed of the resin particles on the latent image carrier; a transferring unit configured to transfer the image composed of the resin particles formed on the latent image carrier to a recording medium; a fixer application unit configured to apply a fixer containing a softener, capable of softening resin by dissolving or swelling at least a part of the resin, and water to the resin particles of the image formed on the recording medium; and an anti-tack agent application unit configured to apply a liquid anti-tack agent immiscible with the softener to surfaces of the resin particles that are mixed with the softener by the application of the fixer containing the softener.

BRIEF DESCRIPTION OF THE DRAWINGS

Other objects and further features of embodiments may become apparent from the following detailed description when read in conjunction with the accompanying drawings, in which.

DESCRIPTION OF THE PREFERRED EMBODIMENTS

In the following, embodiments of the present invention are described with reference to the accompanying drawings.

[First Embodiment]

Figure 1:
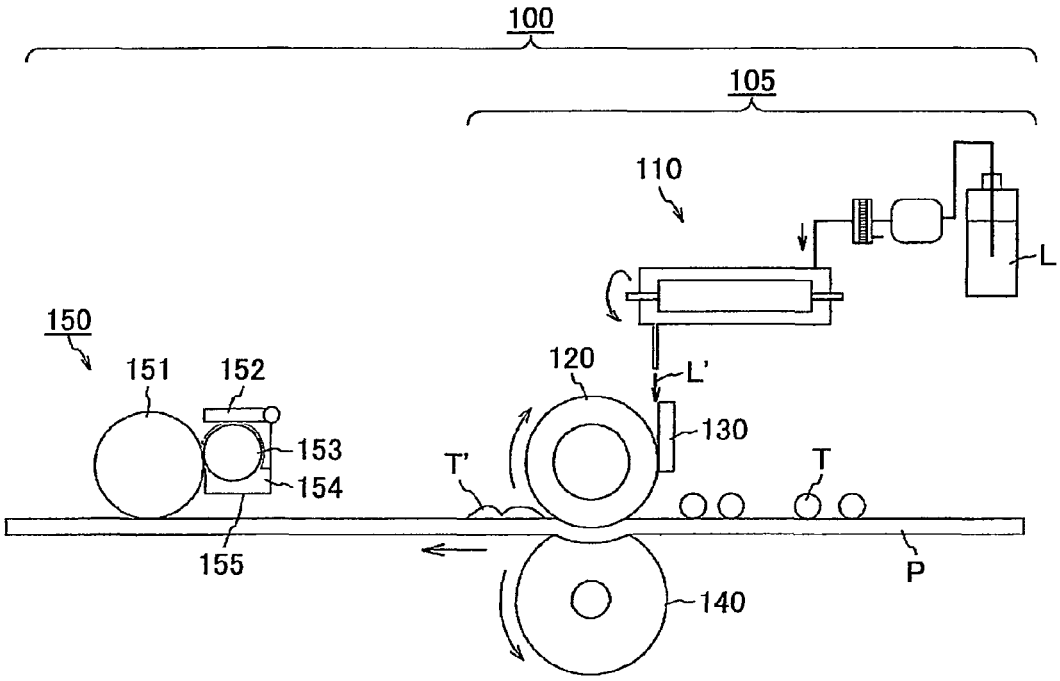
FIG. 1 is a diagram illustrating a schematic configuration of a fixing device according to a first embodiment.

FIG. 1 is a diagram illustrating a schematic configuration of a fixing device according to an embodiment. A recording medium P on which an image composed of resin particles is formed (hereinafter called an "unfixed toner image T") by a not-shown image forming unit is transferred to a fixing device 100 according to the first embodiment.

The fixing device 100 includes a fixing section including a foam fixer generator 110 configured to generate a fixer (liquid fixer) L in a foam state (hereinafter also called a "foam fixer"), an application roller 120 configured to carry the foam fixer L' generated by the foam fixer generator 110 to apply the foam fixer L' to the unfixed toner image T on a recording medium, a blade 130 configured to control a film thickness of the foam fixer L' carried on a surface of the application roller 120, and a pressure roller 140 facing the application roller 120 and configured to apply pressure to the recording medium P such as paper transferred into a nip portion between the application roller 120 and the pressure roller 140; and an anti-tack agent application device 150 configured to apply, after the unfixed toner image T is fixed to the recording medium P, an anti-tack agent to a fixed toner image T'. In FIG. 1, the roller type anti-tack agent application device 150 is illustrated. The roller type anti-tack agent application device 150 includes an anti-tack agent application roller 151, a liquid film thickness control blade 152, an auxiliary application roller 153, and an anti-tack agent tank 155 containing an anti-tack agent 154. The foam fixer L' is applied between the application roller 120 and the blade 130. Note that the volume density of the foam fixer L' is low, so that the foam fixer L' applied on the application roller 120 may be increased. The film thickness of the foam fixer L' may be appropriately selected based on a thickness of the unfixed toner image T formed on the recording medium P, a bubble size of the foam fixer L', viscosity of the foam fixer L', pressure applied to the unfixed toner image T on the recording medium P, and an ambient temperature. Accordingly, the foam fixer L' may be sufficiently applied to the unfixed toner image T so as to form the fixed toner image T' on the recording medium P. Further, it is possible to eliminate a sense of liquid residue from the fixed toner image T' formed on the recording medium P. Further, since adverse effect due to the surface tension of the foam fixer L' is controlled, it is possible to prevent toner offset on the application roller 120. Moreover, the anti-tack agent application device 150 applies a liquid anti-tack agent to a surface of the fixed toner image T' formed on the recording medium P.

Figure 8:
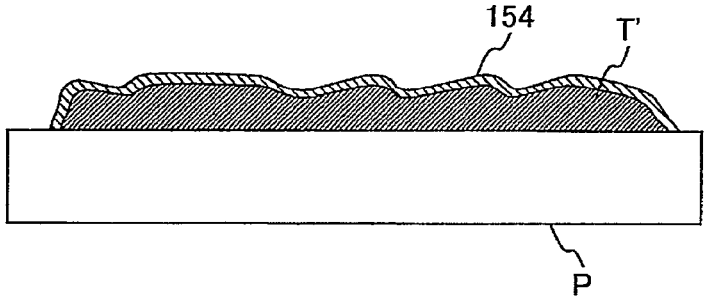
FIG. 8 is a diagram illustrating a profile in which an anti-tack agent is applied to a surface of a fixed toner image on a recording medium.

FIG. 8 is another diagram illustrating a profile in which the anti-tack agent 154 is applied to the surface of the fixed toner image T' on a recording medium. As illustrated in FIG. 8, since the surface of the fixed toner image T' on the recording medium P is covered with the anti-tack agent 154 to prevent the fixed toner image T' from being directly in contact with other recording media or objects, it is possible to prevent the bleed-through or strike-through due to tackiness. The use of an anti-tack agent is a well-known related art method for preventing toner or resin from being attached to rollers or molds when the toner is fixed to the recording medium or resin is molded in a mold by applying heat with a heating roller. However, since the related art method intends to prevent the toner or resin from being attached to the medium or the mold during fixing, a release agent is applied to the roller or the mold.

On the other hand, a method according to the first embodiment intends to lower tackiness in the surface of the fixed toner image T' on the recording medium P, and hence the anti-tack agent 154 is applied on the surface of the fixed toner image T' on the recording medium P, as illustrated in FIG. 8. It is preferable that a material for the anti-tack agent 154 be selected from those that are not miscible with a softener contained in the fixer. If the material for the anti-tack agent 154 is miscible with the softener contained in the fixer and such an anti-tack agent 154 is applied to the surface of the fixed toner image T' containing the softener, the anti-tack agent 154 and the softener be mutually soluble in each other. As a result, the fixed toner image T' may not be covered with the anti-tack agent 154 as illustrated in FIG. 8. Thus, it may not be possible to lower the tackiness in the surface of the fixed toner image T'.

The "miscibility" in this embodiment indicates a state where the softener and the anti-tack agent are uniformly mixed such that the boundary between them cannot be observed with the naked eye. In this case, since the foam fixer L' contained in the fixed toner image T' and the anti-tack agent 154 are uniformly mixed when the fixed toner image T' is covered with the anti-tack agent 154, the fixed toner image T' is not covered with the anti-tack agent 154 as illustrated in FIG. 8. Thus, it may not be possible to lower the tackiness in the surface of the fixed toner image T'. Evaluation of the miscibility may be carried out as follows. A softener and an anti-tack agent placed in a bottle are mixed with a shaker or an ultrasonic homogenizer, the mixture is allowed to stand for a predetermined period, and a change obtained in the mixture after the predetermined period is evaluated. The softener and the anti-tack agent are determined to be mutually "immiscible" if the softener and the anti-tack agent are separated from each other after allowing the mixture to stand for the predetermined period. The softener and the anti-tack agent are determined to be mutually "miscible" if the softener and the anti-tack agent are uniformly mixed with each other after allowing the mixture to stand for the predetermined period, and the boundary between them cannot be observed with the naked eye. Note that one of or both of the softener and the anti-tack agent may become clouded. This may result from the fact that the softener and the anti-tack agent contain small droplets of their corresponding counterparts. In this case, the softener and the anti-tack agent are not mutually mixed at the molecular level or the cluster level. However, since the anti-tack agent is mixed with the softener, a desired effect of the anti-tack agent to lower the tackiness in the surface of the fixed toner image T' may be reduced.

As a material for the anti-tack agent, oily materials may be preferable. However, the material for the anti-tack agent may be selected from the oily materials that are not miscible with the softener. Examples of the softener include fatty ester, citrate ester, and carbonic ester such as ethylene carbonate. Examples of the anti-tack agent that are immiscible with the softener include silicone oil and triglyceride. Examples of the silicone oil include a general silicone oil such as a dimethyl silicone oil, a methyl phenyl silicone oil, a methyl hydrogen silicone oil, and a modified silicone oil. However, a polyether-modified silicone oil having a high hydrophilic property is preferable, and a polyether-modified silicone oil having hydrophile-lypophile balance (HLB value) of 7 or below is particularly preferable.

The backbone of the polyether-modified silicone oil is represented by the following formula (1). Examples of the polyether-modified silicone oil include structures having a polyether group represented by the formula (2), a long chain alkyl group represented by the formula (3), and an aralkyl group represented by the formula (4), which are located at a side chain organic group site of the formula (1).

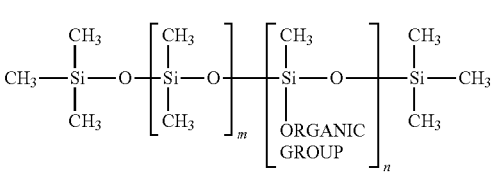

(1)

$$—R(C_2H_4O)_a(C_3H_6O)_bR' \quad (2)$$

$$—C_kH_{2k+1} \quad (3)$$

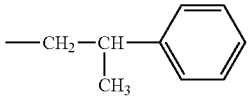

(4)

Since dimethyl silicone has a hydrophobic property against water contained in the fixer L, the thickness of the anti-tack agent 154 containing dimethyl silicone applied to the fixed toner image T' may have partially thin portions. In this case, tackiness in its early phase may be suppressed; however, the thin portions of the anti-tack agent 154 may become thinner as more time has elapsed. This may cause lasting instability of the anti-tack agent 154. On the other hand, if the polyether-modified silicone oil is used as the anti-tack agent 154, fixer wettability may be improved. Thus, the film thickness stability of the anti-tack agent layer applied to the fixed toner image T' may be enhanced, thereby effectively preventing the tackiness in a long period of time. The hydrophilicity of the polyether-modified silicone may be represented by the HLB value. The HLB value may be in a range of 0 to 20, where the greater value indicates greater hydrophilicity. It is preferable that the HLB value be high because it indicates high hydrophilicity to the fixer containing water. However, an increase in the HLB value increases the miscibility between the softener and the anti-tack agent. Accordingly, a preferable HLB value range may be 7 or below because the softener is immiscible with the anti-tack agent having the HLB value within the range.

The triglyceride may form various materials produced by altering a fatty acid site of its structure. Examples of the triglyceride include tridocosahexaenoin, trieicosapentaenoin, 1-palmitoyl-2,3-oleoyl glycerol, 1,3-oleoyl-2-palmitoyl glycerol, 1-palmitoyloleoyl-2-stearoyl-3-linoleoyl glycerol, and 1-linoleoyl-2-palmitoyloleoyl-3-stearoyl glycerol. In addition, an edible oil having triglyceride as a main component may also be suitably used. Examples of the edible oil having triglyceride as the main component include a rapeseed oil, a canola oil, acorn oil, a soybean oil, a sesame oil, and a salad oil. Though also provided as an example of the oily material, fatty acid such as an oleic acid or linoleic acid may be miscible with the softener such as fatty ester, citrate ester, and carbonic ester including ethylene carbonate and propylene carbonate. Thus, some materials formed of fatty acid as a single unit may not be used as the anti-tack agent regarding the materials in combination with the softener. In addition, since the anti-tack agent reduces the tackiness in the surface of the fixed toner image T' by covering the surface of the fixed toner image T', the material for the anti-tack agent may need to have vapor resistance.

The anti-tack agent application device 150 illustrated in FIG. 1 is configured to uniformly apply the liquid anti-tack agent 154 to the surface of the fixed toner image T' on the recording medium P. If too much of the anti-tack agent 154 is applied, the texture of the recording medium P may be changed. By contrast, if too little of the anti-tack agent 154 is applied, the tackiness in the surface of the fixed toner image T' may not be reduced. Accordingly, the anti-tack agent application device 150 needs to uniformly apply a predetermined amount of the anti-tack agent 154 to the surface of the fixed toner image T' on the recording medium P. In FIG. 1, the roller type anti-tack agent application device 150 is illustrated. An amount of the anti-tack agent 154 contained in the anti-tack agent tank 155 is carried on the auxiliary application roller 153, and the liquid film thickness control blade 152 adjusts the amount of the anti-tack agent 154 on the auxiliary application roller 153 such that the adjusted amount of the anti-tack agent 154 is applied from the auxiliary application roller 153 to the anti-tack agent application roller 151. The anti-tack agent application roller 151 on which the adjusted amount of the anti-tack agent 154 is applied is pressed on the recording medium P on which the fixed toner image T' formed. Accordingly, the adjusted amount of the anti-tack agent 154 is applied on the fixed toner image T' formed on the recording medium P. Preferable materials for surfaces of the anti-tack agent application roller 151 and the auxiliary application roller 153 may include those that are not altered with the anti-tack agent 154 so that the anti-tack agent 154 remains on the surfaces of the anti-tack agent application roller 151 and the auxiliary application roller 153. Examples of such materials include metal, rubber, and resin. Among these, rubber is particularly preferable. That is, if the surface of the anti-tack agent application roller 151 is made of rubber, the surface of the anti-tack agent application roller 151 may deform along the surface shape of the recording medium P when pressure is applied to the recording medium P by the anti-tack agent application roller 151. Accordingly, the uniform application in the amount of the anti-tack agent may be achieved.

[Second Embodiment]

Figure 2:
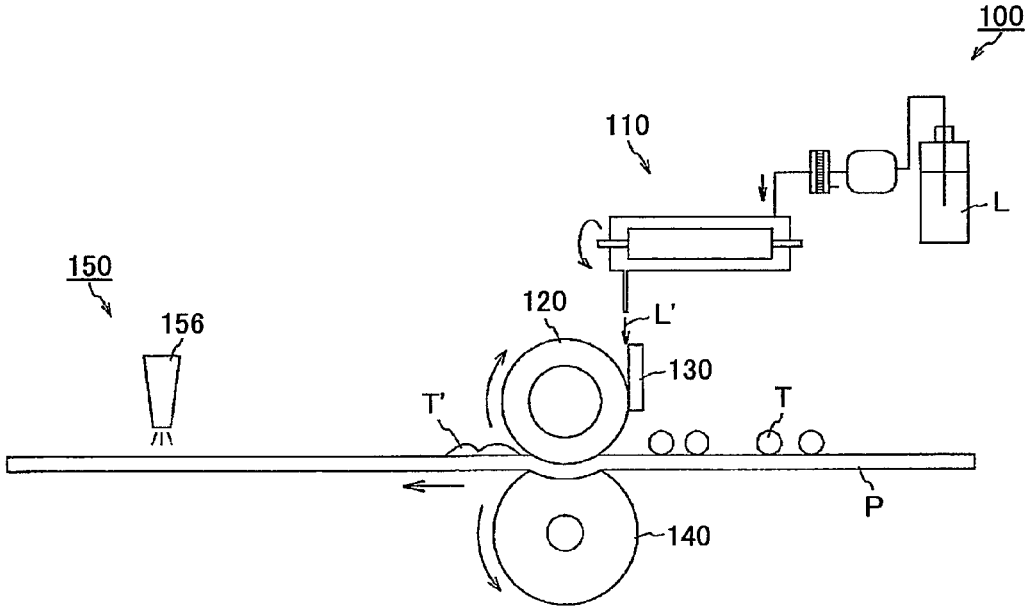
FIG. 2 is a diagram illustrating a schematic configuration of a fixing device according to a second embodiment.

FIG. 2 is a diagram illustrating a schematic configuration of a fixing device according to a second embodiment. The fixing device 100 according to the second embodiment illustrated in FIG. 2 includes a spray type anti-tack agent application device 150. In this configuration, an anti-tack agent supplied from a not-shown anti-tack agent tank is sprayed from an anti-tack agent nozzle 156 so that the anti-tack agent in a mist state is applied to the fixed toner image T' on the recording medium.

Next, a formula for the fixer in a liquid state is described. As described above, the fixer in a foam state is formed by introducing bubbles in the liquid fixer containing a softener. It is preferable that the liquid fixer containing the softener contain a foaming agent and a foam boosting agent in order to form the foam fixer having a uniform size of the bubbles in its bubble layer. In addition, it is preferable that the liquid fixer containing the softener contain a thickening agent in order to stably disperse bubbles in the liquid fixer.

Examples of the foaming agent include anionic surfactants. Among these, fatty acid salts are particularly preferable. Since fatty acid salts include surface active properties, surface tension of the liquid fixer containing water is lowered, which facilitates foaming of the fixer. In addition, since bubble surfaces of the fatty acid salts include layer lamellar structures, bubble walls (Plateau Borders) are stronger than those of other surfacants. Accordingly, foam stability may become extremely high. Further, it is preferable that the fixer contain water in order to enhance foamability of the fatty acid salts. Preferable examples of the fatty acid salts include saturated fatty acids having high resistance to oxidation in view of a lasting stability in the atmosphere. Note that by the addition of a small amount of unsaturated fatty acid salts in the fixer containing the saturated fatty acids, solubility or dispensability of the fatty acids may be facilitated. Further, the fixer containing the saturated fatty acids may exhibit excellent foamability at a low temperature range of 5 to 15° C. Moreover, fixing stability may be obtained in a wide environmental temperature range. Further, the separation of the fatty acid salts in the fixer liquid that has been left for a long period may be prevented. Preferable examples of the fatty acids used in the saturated fatty acid salts include saturated fatty acids having 12, 14, 16, and 18 carbon atoms, which specifically indicate lauric acid, myristic acid, palmitic acid, and stearic acid. The saturated fatty acid salts having carbon atoms of 11 or less exhibit strong odor, which are thus not suitable as the fixer for use in home use or office use image forming apparatuses. On the other hand, the saturated fatty acid salts having carbon atoms of 19 or more exhibit low water solubility, which may lower fixer standing stability. The saturated fatty acid salts made of the aforementioned saturated fatty acids having 12, 14, 16, and 18 carbon atoms given above may be used alone or in combination of two or more as a foaming agent.

Further, the unsaturated fatty acid salts may also be used. Preferable examples of the unsaturated fatty acid salts may be formed of the unsaturated fatty acids having 18 carbon atoms and having 1 to 3 double bonds. More specifically, preferable examples of the unsaturated fatty acid salts include oleic acid, linoleic acid, and linolenic acid. The unsaturated fatty acid salts having 4 or more double bonds exhibit strong reactivity, which may lower standing stability of the fixer. The unsaturated fatty acid salts made of the aforementioned unsaturated fatty acids having 18 carbon atoms and 1 to 3 double bonds given above may be used alone or in combination of two or more as a foaming agent. The saturated fatty acid salts may be mixed with the unsaturated fatty acid salts to be used as a foaming agent. Further, in a case where the saturated fatty acid salts or the unsaturated fatty acid salts are used as a foaming agent for the fixer, it is preferable that the saturated fatty acid salts or the unsaturated fatty acid salts be sodium salts, potassium salts, or amine salts. Capability of the fixing device to be ready to fix images immediately after the power is supplied is one of the most important factors in commercial value of the fixing device. In order for the fixing device to be ready for fixing images, the fixer provided in the fixing device needs to be in an appropriate foam state. The aforementioned fatty acid salts may induce immediate forming of the foam fixer, so that the fixing device containing the fixer containing such fatty acid salts may be capable of getting ready for fixing images immediately after the power is supplied. Specifically, if the amine salts are used as the foaming agent in the fixer, the fixer containing the amine salts may foam in a shortest time when shear force is applied, thereby easily preparing the foam fixer. Accordingly, the fixing device containing the fixer containing such amine salts may be capable of getting ready for fixing images immediately after the power is supplied.

The softener softening the resin by dissolving or swelling the resin includes aliphatic ester. The aliphatic ester has excellent solubility and a swelling property for dissolving or swelling part of the rein contained in toner or the like. In view of non-hazardous effect on a human body, the softener preferably has acute oral toxicity LD 50 of 3 g/kg or higher, more preferably has the acute oral toxicity LD 50 of 5 g/kg. The aliphatic ester has little ill effect on the human body so that the aliphatic ester is used as various cosmetic materials. Further, the fixing of the toner on the recording medium is carried out by a frequently used apparatus in an enclosed environment, and the softener remains in the toner that has been fixed on the recording medium. Thus, it is preferable that the fixing of the toner on the recording medium not generate a volatile organic compound (VOC) and unpleasant odor. That is, it is preferable that the softener in the fixer include no volatile organic compounds (VOC) and no material inducing unpleasant odor. The aliphatic ester has a high boiling point and low volatility, and does not generate irritating odor compared to widely used general-purpose organic solvents such as toluene, xylene, methyl ethyl ketone, and ethyl acetate. Note that as a practical odor sensory measurement for measuring odor with high accuracy in the office environment, an odor index (10*log (dilution factor of a material when odor of the material is not perceived)) measured by a triangle odor bag method used in perceptual evaluation may be used. Further, the odor index of the aliphatic ester contained in the softener is preferably 10 or below. If the aliphatic ester in the softener has the order index of 10 or below, no unpleasant odor may be sensed by users in a normal office environment. In addition, it is preferable that other liquids contained in the fixer other than the softener generate no unpleasant or irritating odor.

In the embodiment, the aliphatic ester contained in the fixer may preferably contain saturated aliphatic ester. If the aliphatic ester in the fixer contains saturated aliphatic ester, preservation stability (resistance to oxidation and hydrolysis) of the softener may be improved. The saturated aliphatic esters have little hazardous effect on the human body. Numerous saturated aliphatic esters may be capable of dissolving or swelling the resin contained in toner within 1 sec. In addition, the saturated aliphatic esters may reduce tackiness texture of the toner provided on the recording medium. The saturated aliphatic esters may be capable of reducing the tackiness texture of the toner on the recording medium because the saturated aliphatic esters form an oil film on the surface of the toner that has been dissolved or swollen. Accordingly, the saturated aliphatic ester contained in the fixer according to the embodiment preferably includes a compound represented by a general formula R1COOR2 where R1 is an alkyl group having 11 to 14 carbon atoms and R2 is a straight-chain alkyl group or a branched-chain alkyl group having 1 to 6 carbon atoms. In the saturated aliphatic ester contained in the fixer according to the embodiment, if the number of carbon atoms for R1 or R2 is less than the corresponding range, odor may be generated, whereas if the number of carbon atoms for R1 or R2 exceeds the corresponding range, resin softening ability may be lowered. That is, if the saturated aliphatic ester contained in the fixer according to the embodiment includes the compound represented by the general formula R1COOR2 where R1 is an alkyl group having 11 to 14 carbon atoms and R2 is a straight-chain alkyl group or a branched-chain alkyl group having 1 to 6 carbon atoms, solubility and the swelling property of the resin contained in the toner may be improved. Further, the odor index of the compound represented by the general formula R1COOR2 is 10 or below, and hence the compound does not generate unpleasant or irritating odor.

Examples of the compound, which is an aliphatic monocarboxylic acid ester, include ethyl laurate, hexyl laurate, ethyl tridecanoate, isopropyl tridecanoate, ethyl myristate, and isopropyl myristate. Numerous aliphatic monocarboxylic acid esters corresponding to the above compound are dissolved in lipid solvents but not dissolved in water. Thus, in many of the aliphatic monocarboxylic acid esters corresponding to the above compound, aqueous solvent glycols may be contained as an adjuvant in the fixer, and the glycols contained in the fixer are dissolved or in micro emulsion form. Further, the aliphatic ester contained in the fixer preferably contains an aliphatic dicarboxylic acid ester. If the aliphatic ester in the fixer contains the aliphatic dicarboxylic acid ester, the resin contained in the toner may be dissolved or swollen in even less time. For example, in high-speed printing exhibiting approximately 60 ppm, the time (duration) required for fixing the toner on the recording medium after the fixer is applied to unfixed toner on the recording medium may be preferably within 1 sec. If the aliphatic ester in the fixer contains the aliphatic dicarboxylic acid ester, the time (duration) required for fixing the toner on the recording medium after the fixer is applied to unfixed toner on the recording medium may be within 0.1 sec. Further, if the aliphatic ester in the fixer contains the aliphatic dicarboxylic acid ester, the resin contained in the toner may be dissolved or swollen by adding a smaller amount of the softener in the fixer. Accordingly, the amount of the softener contained in the fixer may be reduced.

Accordingly, the saturated aliphatic dicarboxylic acid ester contained in the fixer according to the embodiment preferably includes a compound represented by a general formula R3(COOR4)2 where R3 is an alkylene group having 3 to 8 carbon atoms and R4 is a straight-chain alkyl group or a branched-chain alkyl group having 3 to 5 carbon atoms. In the saturated aliphatic ester contained in the fixer according to the embodiment, if the number of carbon atoms for R3 or R4 is less than the corresponding range, odor may be generated, whereas if the number of carbon atoms for R3 or R4 exceeds the corresponding range, resin softening ability may be lowered. That is, if the saturated aliphatic dicarboxylic acid ester contained in the fixer according to the embodiment includes the compound represented by the general formula R3(COOR4)2 where R3 is the alkylene group having 3 to 8 carbon atoms and R4 is the straight-chain alkyl group or the branched-chain alkyl group having 3 to 5 carbon atoms, solubility and the swelling property of the resin contained in the toner may be improved. Further, the odor index of the compound represented by the general formula R3(COOR4)2 is 10 or below, and hence the compound does not generate unpleasant or irritating odor.

Examples of the aliphatic dicarboxylic acid ester include diethylhexyl succinate, dibutyl adipate, diisobutyl adipate, isopropyl adipate, diisodecyl adipate, diethyl sebacate, and dibutyl sebacate. Many of the aliphatic monocarboxylic acid esters are dissolved in lipid solvents but not dissolved in water. Thus, in many of the aliphatic monocarboxylic acid esters, aqueous solvent glycols may be contained as adjuvant in the fixer, and the glycols contained in the fixer are dissolved or in micro emulsion form. Further, the aliphatic ester contained in the fixer preferably contains aliphatic dicarboxylate dialkoxyalkyl. If the aliphatic ester in the fixer contains the aliphatic dicarboxylate dialkoxyalkyl, fixing stability of the toner on the recording medium may be improved.

Accordingly, the aliphatic dicarboxylate dialkoxyalkyl contained in the fixer according to the embodiment preferably includes a compound represented by a general formula R5(COOR6-O—R7)2 where R5 is an alkylene group having 2 to 8 carbon atoms, R6 is an alkylene group having 2 to 4 carbon atoms, and R7 is an alkyl group having 1 to 4 carbon atoms. In the saturated aliphatic ester contained in the fixer according to the embodiment, if the number of carbon atoms for R5, R6, or R7 is less than the corresponding range, odor may be generated, whereas if the number of carbon atoms for R5, R6, or R7 exceeds the corresponding range, resin softening ability may be lowered. That is, if the aliphatic dicarboxylate dialkoxyalkyl contained in the fixer according to the embodiment includes the compound represented by the general formula R5(COOR6-O—R7)2 where R5 is the alkylene group having 2 to 8 carbon atoms, R6 is the alkylene group having 2 to 4 carbon atoms, and R7 is the alkyl group having 1 to 4 carbon atoms, solubility and the swelling property of the resin contained in the toner may be improved. Further, the odor index of the compound represented by the general formula R5(COOR6-O—R7)2 is 10 or below, and hence the compound does not generate unpleasant or irritating odor.

Examples of the aliphatic dicarboxylate dialkoxyalkyl include diethoxyethyl succinate, 2-butoxyethyl succinate, diethoxyethyl adipate, 2-butoxyethyl adipate, and diethoxyethyl sebacate. Thus, in many of the aliphatic dicarboxylate dialkoxyalkyls, aqueous solvent glycols may be contained as adjuvant in the fixer, and the glycols contained in the fixer are dissolved or in micro emulsion form. A citrate ester or a carbonic ester such as ethylene carbonate or propylene carbonate may also be suitable for the softener though they are not fatty esters.

Note that when the foam fixer is pressed onto a particle layer composed of toner or the like at a contact application nip portion to cause the foam fixer to penetrate into the particle layer, and the bubbles of the foam fixer break, the penetration of the foam fixer into the particle layer may be inhibited. Accordingly, foam stability may be required. It is preferable that the fixer contain fatty acid alkanolamide (1:1) type in order to enhance foam stability. Although there are a fatty acid alkanolamide (1:1) type and a fatty acid alkanolamide (1:2) type, the fatty acid alkanolamide (1:1) type appears to be suitable for enhancing foam stability. Note that the particles containing the resin to be fixed on the recording medium are not limited to the toner but any particles insofar as they contain resin. Further, the recording medium used in the embodiment is not limited to recording paper but may be any one of metal, resin, ceramics, and the like. Note that it is preferable that the recording medium have permeability. If the medium substrate does not have liquid permeability, it is preferable that a liquid penetrating layer be formed on the medium substrate. Further, the recording medium is not limited to a sheet type but may be a three-dimensional object. For example, the embodiment may be used for uniformly fixing transparent resin particles on a medium such as paper to protect a surface of the paper (so-called varnishing).

Among the particles having the resin, the highest effect in fixing may be observed with the toner generally used in an electrophotographic process in combination with the fixer according to the embodiment. The toner includes a coloring material, a charging control agent, and resin such as a binder or a releaser. The resin contained in the toner is not particularly specified. Preferable examples of the binder resin include polystyrene resin, styrene-acrylate copolymer, and polyester resin, whereas preferable examples of the releaser include a wax component galvano wax or polyethylene. The toner may contain well-known coloring agent, charge control agent, fluidity providing agent, and an external additive in addition to the binder resin. Further, it is preferable that the toner be provided with water repellent treatment by fixing hydrophobic particles such as hydrophobic silica and titanium oxide over surfaces of the toner particles. The recording medium is not particularly specified. Preferable examples of the recording medium include paper, cloth, and a plastic film such as an OHP sheet that includes a transparent layer. Oiliness in this embodiment indicates that solubility in water at room temperature of about 20° C. is 0.1 wt % or less.

Further, it is preferable that the fixer in a foam state (foam fixer) have sufficient affinity for the toner particles that have been provided with water-repellent treatment. Note that affinity in this embodiment indicates extended wettability of liquid on a surface of a solid when the liquid is in contact with the solid. That is, it is preferable that the fixer in a foam state (foam fixer) have sufficient wettability on surfaces of the toner particles that have been provided with water-repellent treatment. The surfaces of the toner particles water-repellently treated for toner hydrophobic particles such as hydrophobic silica and hydrophobic titanium oxide are covered with a methyl group arranged on the surfaces of the hydrophobic silica and hydrophobic titanium, and have surface energy of 20 mN/m. In reality, since not all the surfaces of the toner particles treated for water-repellency are completely covered with hydrophobic particles, the surface energy of the toner treated for water-repellency may be in a range of 20 to 30 mN/m. Thus, it is preferable that the fixer in a foam state (foam fixer) have surface tension of 20 to 30 mN/m to exhibit sufficient affinity for the toner particles or wettability on surfaces of the toner particles that have been provided with water-repellent treatment. If an aqueous solvent is used, it is preferable to add a surfactant to the fixer in a foam state (foam fixer) so that the foam fixer has surface tension of 20 to 30 mN/m. Further, if the aqueous solvent is used, it is preferable that the fixer in a foam state (foam fixer) have monohydric alcohol or polyhydric alcohol. The aforementioned materials contained in the foam fixer have advantages for increasing foam stability and decreasing the breakage of the foam. For example, it is preferable that such preferable materials be monohydric alcohol such as cetanol, or polyhydric alcohol such as glycerin, propylene glycol, and 1,3-butylene glycol. Further, the medium such as paper may be prevented from curling by adding such monohydric alcohol or polyhydric alcohol to the foam fixer.

Moreover, it is preferable to form O/W emulsion or W/O emulsion by adding an oil component into the fixer in order to improve permeability of the fixer into the medium or prevent the medium such as paper from curling. In forming the O/W emulsion or W/O emulsion by adding the oil component into the fixer, a disperser may be added. Preferable examples of the disperser include sorbitan fatty acid esters such as sorbitan monooleate and sorbitan monostearete, and sucrose esters such as sucrose laurate and sucrose stearate. In this embodiment, the foam fixer may preferably have a volume density range of 0.01 to 0.1 g/cm$^3$, more preferably have volume density of 0.01 to 0.05 g/cm$^3$, and particularly preferably have volume density of 0.25 to 0.05 g/cm$^3$. The foam fixer having the volume density lower than 0.01 g/cm$^3$ may result in insufficient supply of the fixer, whereas the foam fixer having the volume density exceeding 0.1 g/cm$^3$ may result in liquid residues on the recording medium when the fixer is applied to the recording medium. Further, it is preferable that the foam fixer have a bubble size range of 5 to 50 μm. With this configuration, the foam fixer may be applied to the resin particles having a particle size range of 5 to 10 μm formed on the recording medium without changing the particle size range. The film thickness of the foam fixer may be appropriately selected based on a thickness of the unfixed toner image T formed on the recording medium P, a bubble size of the foam fixer L', viscosity of the foam fixer L', pressure applied to the unfixed toner image T on the recording medium P, and an ambient temperature.

Figure 3:
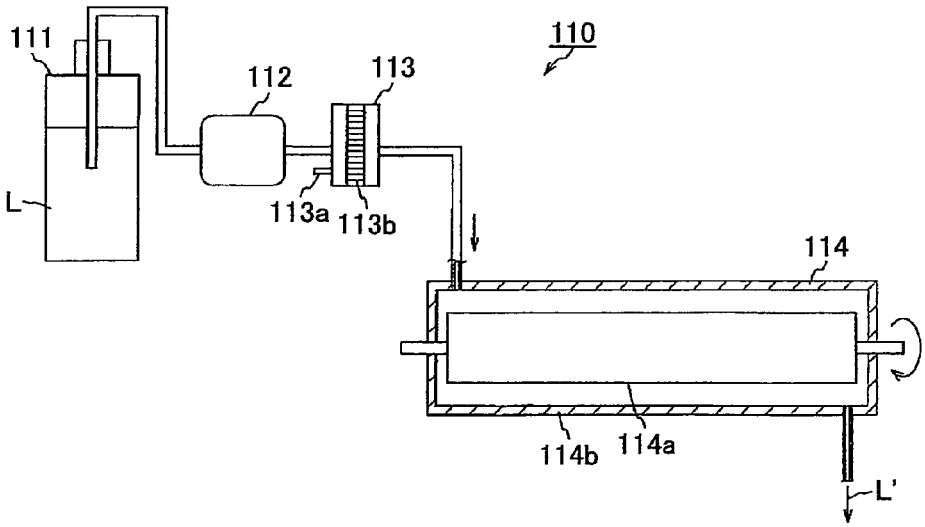
FIG. 3 is an enlarged diagram illustrating a foam fixer generator residing in the fixing devices illustrated in FIG. 1 and FIG. 2.

FIG. 3 is an enlarged diagram illustrating the foam fixer generator 110 residing in the fixing device 100 of FIG. 1 or FIG. 2 viewed in a direction opposite to the direction (i.e., in a direction from a rear side of the foam fixer generator 110) illustrated in FIG. 1. As illustrated in FIG. 3, the foam fixer generator 110 includes a container 111 configured to contain the fixer L, a pump 112 configured to transfer the fixer L from the container 111, a coarse foam generator section 113 configured to generate coarse foam having a bubble size range of 0.5 to 1 mm in the transferred fixer L, and a microporous foam generator section 114 configured to split the coarse foam by applying shear force to the fixer L in the coarse foam to form microporous foam. In this manner, the microporous foam having a bubble size range of 5 to 50 μm may be generated in the fixer L to form the fixer in a foam state (foam fixer) L'. Preferable examples of the pump 112 are not particularly specified but include a gear pump, a bellows pump, a tube pump, and the like. Among these, the tube pump may be most preferable. Since the fixer L is pushed out by deforming a tube of the tube pump, the member in that is brought into contact with the fixer L is the tube alone. Thus, contamination of the fixer L or deterioration in components of the pump may be prevented by employing the tube having a liquid resistance to the fixer L for the tube of the tube pump. Further, with the tube pump, since the fixer L is pushed out by deforming the tube, generation of bubbles in the fixer L and a decrease in the transferring ability of the pump are suppressed.

The coarse foam generator section 113 includes an air port 113*a* and a microporous sheet 113*b* having a porous size range of 30 to 100 μm. In the coarse foam generator section 113, since a negative pressure is generated in the air port 113*a* while the fixer L is transferred to the coarse foam generator section 113, air introduced via the air port 113*a* is mixed with the fixer L. Further, the coarse foam having a uniform bubble size is generated by allowing the fixer L mixed with the introduced air to pass through the microporous sheet 113*b*. Note that the coarse foam generator section 113 may include a porous member with a continuous foam structure having a porous size range of 30 to 100 μm instead of the microporous sheet 113*b*. Examples of the porous member with the continuous foam structure include, but not limited to, a sintering ceramic plate, nonwoven fabric, and a resin foam sheet. Further, the coarse foam generator section 113 may include impellers configured to stir the fixer L instead of the air port 113*a* and the microporous sheet 113*b* so as to generate the coarse foam by causing air bubbles to be involved in the fixer L. Or the coarse foam generator section 113 may include an air supply pump configured to form the coarse foam by causing the fixer L to generate bubbles. The microporous foam generator section 114 has a closed double cylinder structure composed of a rotational inner cylinder 114*a* and an outer cylinder 114*b*. When he fixer L is introduced from a part of the outer cylinder 114*b* and passes through a gap between the rotating inner cylinder 114*a* and the outer cylinder 114*b*, shear force is applied to the fixer that has passed through the gap between the rotating inner cylinder 114*a* and the outer cylinder 114*b*. Thus, the microporous foam is generated by splitting the coarse form, and the obtained foam fixer L' is discharged from another part of the outer cylinder 114*b*. Note that the inner cylinder 114*a* may be provided with a spiral groove in order to improve transferring ability to transfer the coarse foam of the fixer L inside the microporous foam generator section 114.

Figure 4A:
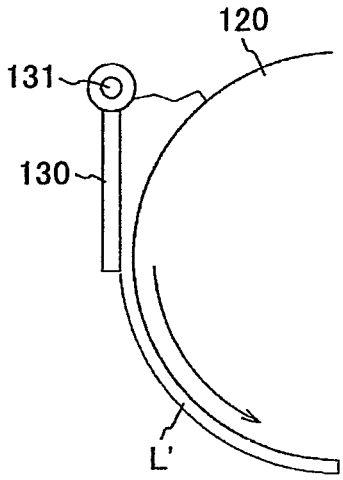
FIGS. 4A and 4B are diagrams illustrating respective blades utilized in the fixing devices illustrated FIG. 1 and FIG. 2.
Figure 4B:
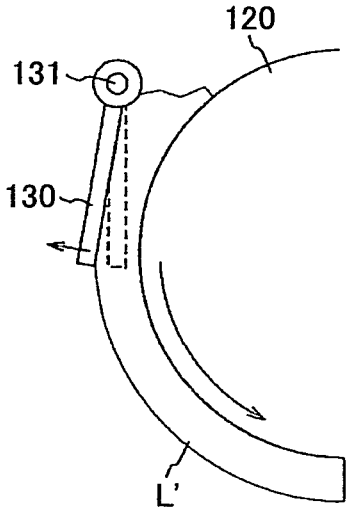

FIGS. 4A and 4B are diagrams illustrating respective blades 130 utilized in the fixing devices 100 illustrated FIG. 1 and FIG. 2 and their operations. As illustrated in FIGS. 4A and 4B, the blade 130 is arranged at a position having a gap range of 10 to 100 μm between a rotational shaft 131 provided at a first end of the blade 130 and the application roller 120. Note that a gap between a second end of the blade 130 and the application roller 120 may be reduced to decrease the film thickness of the foam fixer L' (see FIG. 4A) whereas the gap between the second end of the blade 130 and the application roller 120 may be increased to increase the film thickness of the foam fixer L' (see FIG. 4B). Note also that a wire bar may be employed instead of the blade 130. With this configuration, formation of a uniform film thickness of the foam fixer L' in a shaft direction of the application roller 120 may be improved.

The pressure roller 140 is configured to include an elastic layer composed of sponge (elastic porous member) capable of being greatly deformed with the application of low pressure. With this configuration, the pressure roller 140 may acquire a nip time range of 50 to 30 ms. The nip time needs to be controlled such that the application roller 120 is capable of separating from the recording medium P after the foam fixer L' has penetrated the unfixed toner image T to reach the recording medium P. Note that the nip time indicates the ratio of a nip width to a transferring speed of the recording medium P. The transferring speed of the recording medium P may be computed based on design data of a paper transferring drive mechanism. The nip width may be computed as follows. A thin pigmented coating is applied over the entire surface of the application roller 120. The recording medium P is sandwiched between the application roller 120 and the pressure roller 140 and the sandwiched recording medium P then has pressure applied, so that the pigmented coating is attached on the recording medium P. A length of the pigmented coating attached on the recording medium P in the paper transferring direction is measured. The obtained measurement corresponds to the nip width. Accordingly, the nip width may need controlling based on the transferring speed of the recording medium P. However, the nip width may be controlled by altering a center distance between the application roller 120 and the pressure roller 140. It is preferable that the sponge of the pressure roller 140 be formed of a material that is not dissolved or swollen with the softener. Alternatively, a surface of the sponge may be covered with a flexible film that is not dissolved or swollen with the softener. Examples of the sponge material include, but are not limited to, polyethylene, polypropylene, and polyamide. Examples of the flexible film include, but are not limited to, polyethylene terephthalate, polyethylene, polypropylene, and a tetrafluoroethylene-perfluoroalkylvinyl ether copolymer (PFA). Note also that an elastic rubber may be employed instead of the sponge for the pressure roller 140.

It is preferable that the fixing device 100 include an front end detector configured to detect a front end of the recording medium P upstream of the application roller 120 relative to the transferring direction of the recording medium P. With this configuration, the foam fixer L' is formed on the application roller 120 in an amount such that the foam fixer L' is only applied to the recording medium P, based on a detected signal of the front end detector. Thus, even if the application roller 120 and the pressure roller 140 are constantly in contact with each other, the foam fixer L' formed on the application roller 120 may be prevented from being attached to the pressure roller 140 during a standby state of the fixing device where the recording medium P is not transferred. Further, the fixing device 100 may be configured such that the application roller 120 is separated from the pressure roller 140 during a standby state of the fixing device where the recording medium P is not transferred and the application roller 120 is brought into contact with the pressure roller 140 only while the foam fixer L' formed on the application roller 120 is applied to the recording medium P by the paper transferring drive mechanism. It is preferable that the fixing device 100 having this configuration further include the front end detector configured to detect the front end of the recording medium P, such that the application roller 120 and the pressure roller 140 are brought into contact with each other based on the detected signal of the front end detector. Further, it is preferable that the fixing device 100 having this configuration further include a rear end detector configured to detect a rear end of the recording medium P, such that the application roller 120 and the pressure roller 140 are separated from each other based on the detected signal of the rear end detector. Moreover, it is preferable that the fixing device 100 having this configuration further include a pair of flattening rollers (hard rollers) configured to apply pressure to the recording medium P on which a fixed toner image T' is formed. With this configuration, the surface of the fixed toner image T' may be flattened to be provided with glossiness. Further, with this configuration, the fixing stability of the fixed toner image T' on the recording medium P may be improved.

[Third Embodiment]

Figure 5:
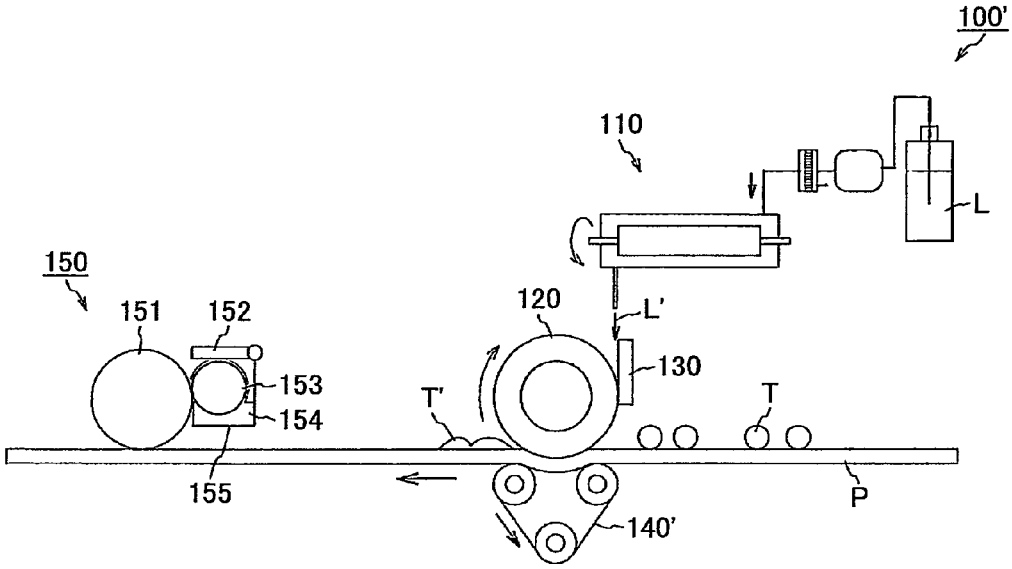
FIG. 5 is a diagram illustrating a schematic configuration of a fixing device according to a third embodiment.

FIG. 5 is a diagram illustrating a schematic configuration of a fixing device according to a third embodiment. As illustrated in FIG. 5, a fixing device 100' according to the third embodiment differs from the fixing device 100 illustrated in FIG. 1 in that the fixing device 100' according to the third embodiment includes a pressure belt 140' instead of the pressure roller 140 as a pressure member configured to apply pressure to the recording medium P transferred into a nip portion between the application roller 120 and the pressure belt 140' located at a side facing the application roller 120, and the configuration other than having the pressure belt 140' remains the same as that of the fixing device 100 in FIG. 1. With this configuration, the fixing device 100' according to the third embodiment may easily widen the nip width of a portion to which pressure is applied. Preferable examples of the pressure belt 140' include, but not limited to, belts obtained by coating fluorocarbon resin on a substrate such as a seamless nickel belt and a seamless PET belt. Note also that the configuration of the fixing device 100' illustrated in FIG. 5 may include an application belt instead of the application roller 120, and a pressure roller 140 instead of the pressure belt 140' (an application belt is employed instead of the application roller 120 in FIG. 1).

Figure 6:
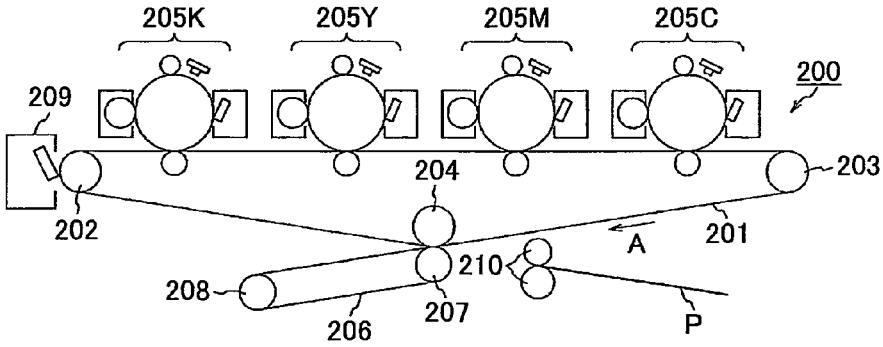
FIG. 6 is a diagram illustrating a schematic configuration of a tandem type image forming apparatus as an example of an image forming apparatus incorporating the fixing device according to the first to third embodiments.

FIG. 6 is a diagram illustrating a schematic configuration of a tandem type image forming apparatus 200 as an example of an image forming apparatus incorporating the fixing device according to the first to third embodiments. Note that the image forming apparatus 200 may be any one of a photocopier, a printer, or a MFP multifunctional peripheral having functions of the photocopier and the printer combined with a facsimile function. The image forming apparatus 200 includes an intermediate transfer belt 201 configured to carry an unfixed toner image T. The intermediate transfer belt 201 is looped over three rotational supporting rollers (i.e., first, second and third supporting rollers) 202, 203, and 204 that rotationally travel in a direction indicated by an arrow A in FIG. 6. In the image forming apparatus 200, for example, four image forming units 205K, 205Y, 205M, and 205C for forming images in colors of black (K), yellow (Y), magenta (M), and cyan (C) are arranged on the intermediate transfer belt 201. A not-shown exposing device is arranged above the four image forming units 205K, 205Y, 205M, and 205C.

For example, if the image forming apparatus 200 is the photocopier, image information of a document is read by a not-shown scanner and exposure light L is emitted from the not-shown exposing device to write a latent image based on the read image information. An intermediate transfer belt 201 is arranged such that the secondary transfer belt 206 faces the supporting roller 204 via the intermediate transfer belt 201. The secondary transfer belt 206 is looped over two supporting rollers 207 and 208. Note that in the image forming apparatus 200, a (secondary) transfer roller may be employed instead of the secondary transfer belt 206. A belt cleaning device 209 configured to remove residual toner remaining on the intermediate transfer belt 201 is arranged at a position that faces the supporting roller 202 via the intermediate transfer belt 201. Meanwhile, the recording medium P is fed from a not-shown paper feeder via a pair of feeding rollers (herein after also called "resist rollers") 210, and the unfixed toner image T is transferred onto the recording medium P by pressing the secondary transfer belt 206 on the intermediate transfer belt 201. The recording medium P onto which the unfixed toner image T is transferred is carried by the secondary transfer belt 206, and the fixing device 100 (not shown in FIG. 6) illustrated in FIG. 1 or 2 fixes the unfixed toner image T on the recording medium P. In this process, the unfixed toner image T transferred onto the recording medium P has applied the foam fixer L' having the controlled film thickness based on the image information from the not-shown exposing device for such as a color image or a black solid image, as described above. Thereafter, the anti-tack agent application device 150 applies the anti-tack agent onto the recording medium P that carries the fixed toner image T'.

Figure 7:
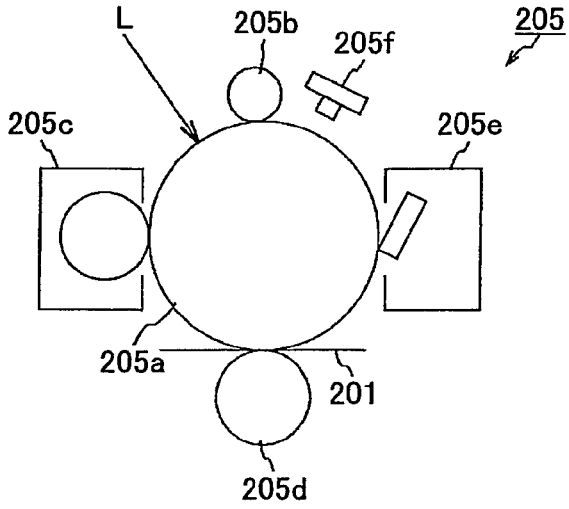
FIG. 7 is a diagram illustrating a configuration example of an image forming unit residing in the image forming apparatus illustrated in FIG. 6.

FIG. 7 is a diagram illustrating a configuration example of one of the image forming units for corresponding colors residing in the image forming apparatus 200 illustrated in FIG. 6. As illustrated in FIG. 7, the image forming unit 205 includes a charging roller 205*b*, a development device 205*c*, a primary transfer roller 205*d*, a cleaning device 205*e* and a static eliminator lamp 205*f* that are arranged in the periphery of a photoconductor drum 205*a* used as a latent image carrier. Note that the image forming unit 205 may be a process cartridge having at least one of the photoconductor drum 205*a*, the charging roller 205*b*, the development device 205*c*, the primary transfer roller 205*d*, the cleaning device 205*e* and the static eliminator lamp 205*f* uniformly combined with a cartridge. The charging roller 205*b* is a contact type charging device configured to make contact with the surface of the photoconductor drum 205*a* to apply a voltage to the photoconductor drum 205*a*, thereby uniformly charging the surface of the photoconductor drum 205*a*. Note that the image forming unit 205 may include a noncontact type charging device having a noncontact scorotron charger instead of the charging roller 205*b*. The development device 205*c* attaches the toner in the developer to the latent image written on the photoconductor drum 205*a* by an exposure light L emitted from the not-shown exposing device. Note that the development device 205*c* includes a not-shown stirrer section and a not-shown development section, where unused developer is transferred back to the stirrer section to be reused in a next development. Toner concentration in the stirrer section is detected by a toner concentration sensor to control the toner concentration at a constant level.

The primary transfer roller 205*d* is arranged such that the primary transfer roller 205*d* faces the photoconductor drum 205*a* via the intermediate transfer belt 201. With this configuration, the primary transfer roller 205*d* is pressed on the photoconductor drum 205*a* via the intermediate transfer belt 201 to apply a transfer bias to the photoconductor drum 205*a*, thereby transferring the unfixed toner image T formed on the photoconductor drum 205*a* onto the intermediate transfer belt 201. Note that the image forming unit 205 may include a noncontact type transfer device such as a noncontact corona charger or a conductive brush instead of the primary transfer roller 205*d*. The cleaning device 205*e* is configured to remove residual toner remaining on the surface of the photoconductor drum 205*a*. The cleaning device 205*e* includes a blade or a brush, a front end of either of which is capable of contacting the surface of the photoreceptor drum 205*a*, or a rotational brush roller. Note that the toner collected by the cleaning device 205*e* is collected by a not-shown collecting screw or a not-shown toner recycling device to be returned back to the development device 205*c* so that the collected toner is reused in a next development. Further, the static eliminator lamp 205*f* initializes a surface potential of the photoreceptor drum 205*a* by the application of light.

EXAMPLES

Subsequently, examples of the embodiments and corresponding comparative examples are described below.

[Fixer 1]

Fatty acid composed of a myristic acid (Kanto Chemical Co., Inc.), a palmitic acid (Kanto Chemical Co., Inc.), and a stearic acid (Kanto Chemical Co., Inc.) was introduced into ion exchanged water at a weight ratio of 4:3:1 and triethanolamine was introduced into the ion exchanged water so that a molar ratio of the triethanolamine to the fatty acid is 0.7. The mixture was then stirred at 80° C. for 30 minutes and self-cooled to prepare a fatty acid diethanolamine salt solution (a solution A). Subsequently, the solution A, propylene carbonate (Kanto Chemical Co., Inc.) used as a softener and coconut fatty acid diethanol amido (1:1) type (Marpon MM by Matsumoto Yushi Seiyaku Co., Ltd.) were mixed into ion exchanged water such that the contents of the fatty acid of the solution A, the propylene carbonate and the coconut fatty acid diethanol amido (1:1) type were respectively 4 wt %, 40 wt %, and 0.5 wt %. The obtained mixture was then stirred by an ultrasonic homogenizer to prepare a fixer 1.

[Fixer 2]

The same solution A used for preparing the fixer 1 was employed. The solution A, dicarbitol succinate (Kokyu Alcohol Kogyo Co., Ltd.) used as a softener and coconut fatty acid diethanol amido (1:1) type (Marpon MM by Matsumoto Yushi Seiyaku Co., Ltd.) were mixed in ion exchanged water such that the contents of the fatty acid of the solution A, the dicarbitol succinate and the coconut fatty acid diethanol amido (1:1) type were respectively 4 wt %, 30 wt %, and 0.5 wt %. The obtained mixture was then stirred by the ultrasonic homogenizer to prepare a fixer 2.

[Fixer 3]

The same solution A used for preparing the fixer 1 was employed. The solution A, diethoxyethyl succinate (Croda DES by Croda Japan KK) used as a softener and coconut fatty acid diethanol amido (1:1) type (Marpon MM by Matsumoto Yushi Seiyaku Co., Ltd.) were mixed in ion exchanged water such that the contents of the fatty acid of the solution A, the diethoxyethyl succinate and the coconut fatty acid diethanol amido (1:1) type were respectively 4 wt %, 10 wt %, and 0.5 wt %. The obtained mixture was then stirred by the ultrasonic homogenizer to prepare a fixer 3.

[Image Forming Method]

An electrophotographic printer IPSiO CX8800 (manufactured by Ricoh Company, Ltd.) was used as an image forming apparatus, and a PPC sheet T-6200 (manufactured by Ricoh Company, Ltd.) was used as a recording paper. An unfixed toner image (color image) was formed on the recording paper (PPC sheet T-6200) using the image forming apparatus (electrophotographic printer IPSiO CX8800). Subsequently, the unfixed toner image is fixed on the recording paper using the fixing device 100 illustrated in FIG. 1.

Fixing evaluations were carried out as follows. First, the prepared fixers were converted to a foam state by the foam fixer generator 110 illustrated in FIG. 3. A PET (polyethylene terephthalate) resin bottle was used as the container 11, and a tube type silicone rubber pump having an inner diameter of 2 mm was used as the pump 112. A silicone rubber tube having an inner diameter of 2 mm was used as a duct for the pump 112 to transfer the fixer L. Stainless steel mesh sheet (400 mesh sheet) having a pore size of approximately 40 μm was used as the microporous sheet 113*b* of the coarse foam generator section 113. The inner cylinder 114*a* and the outer cylinder 114*b* of the microporous foam generator section 114 were made of PET (polyethylene terephthalate). The inner cylinder 114*a* was formed to have an outer diameter of 8 mm and a length of 100 mm, whereas the outer cylinder 114*b* was formed to have an inner diameter of 10 mm and a length of 120 mm. The inner cylinder 114*a* of the microporous foam generator section 114 was fixed on a rotational shaft so that the inner cylinder 114*a* of the microporous foam generator section 114 was rotationally driven by a rotational drive motor (not shown). The inner cylinder 114*a* of the microporous foam generator section 114 was rotated at a speed of 300 rpm for 10 sec. to prepare a foam fixer. The obtained foam fixer was supplied to the application roller 120. A stainless steel SUS roller having PFA resin bake finish and having a diameter of 30 mm was used as the application roller 120. An aluminum alloy roller (cored bar) having a diameter of 10 mm on which a polyurethane foam material (Color Foam EMO produced by INOAC CORPORATION) was formed was used as the application roller 140. An aluminum alloy supporting plate to which a sheet glass with a thickness of 1 mm was attached was used as the blade 130. In the blade 130, a surface of the glass sheet was directed at the application roller 120 side. A gap between the blade 130 and the application roller 120 was adjusted at 40 μm or 100 μm. The thickness of the foam fixer L' formed on the application roller 120 was adjusted approximately to 70 μm or 150 μm. Note that the transferring speed of the recording medium P was set at 300 mm/sec. The unfixed toner image T on the recording medium P in the transferring process was set in a range of 30 to 40 μm.

As examples for triglyceride used as the anti-tack agent, canola oil (Nisshin canola oil produced by Nisshin OilliO Group Ltd.), sesame oil (TAIHAKU Sesame Oil produced by Takemoto Oil & Fat Co., Ltd.), and tridocosahexaenoin (produced by Seikagaku Biobusiness Corporation) were used. As examples of silicone oil used as the anti-tack agent, dimethyl silicone oil ("SH-200" produced by Dow Corning Toray Co., Ltd.), methylphenyl silicone oil (product No.: "KF-50", viscosity: 100 cSt; produced by Shin-Etsu Chemical Co., Ltd.), and a polyether-modified silicone oil (product No.: "X22-2516", viscosity: 70 cSt, HLB value: 1, a chemical structure where the above formulas (2), (3), and (4) were applied to the side chain of the backbone of the above formula (1); produced by Shin-Etsu Chemical Co., Ltd.) were used. An oleic acid (produced by Tokyo Chemical Industry Co., Ltd.) and a linoleic acid (Kanto Chemical Co., Inc.) were prepared for Comparative Examples as the anti-tack agents that were miscible with a softener contained in the fixer.

TABLE 1 illustrates results of miscibility evaluation obtained by the following Examples and Comparative Examples where the toner image is fixed on the recording medium using the above fixers and anti-tack agents. The miscibility was evaluated as follows. The softener in the fixer and the anti-tack agent were placed in a bottle and then stirred by the ultrasonic homogenizer. After allowing the mixture to stand for a certain period of time, the miscibility was evaluated. If the softener and the anti-tack agent were separated in two phases, the softener in the fixer and the anti-tack agent were evaluated as immiscible, whereas if the softener and the anti-tack agent were not separated in two phases, the softener in the fixer and the anti-tack agent were evaluated as miscible. If the softener and the anti-tack agent were separated in two phases but the two phases became cloudy due to containing corresponding counterpart particles, the softener in the fixer and the anti-tack agent were evaluated as dispersed.

The tackiness of the toner formed on the recording medium was evaluated using a tackiness tester (manufactured by Rhesca Corporation). After a cylindrical stainless probe having a diameter of 8.0 mm was pressed on a fixed image forming area (i.e., a fixed toner image formed on the recording medium) at compressive load of 100 gf for 20 sec., the probe was then pulled at a speed of 120 mm/min. The stress applied while the probe was being pulled was measured. The obtained tackiness having a stress range of 0.0 to 4.0 kPa was evaluated as at a non-image forming area level or "almost no tackiness", the tackiness having a stress range exceeding 4.0 kPa to 10.0 kPa was evaluated as "low tackiness", and the tackiness having a stress range exceeding 10.0 kPa was evaluated as "high tackiness". Note that tackiness was evaluated as "present" when the obtained stress in pulling the probe exceeded 4.0 kPa.

| TEST NO. | FIXER | EXAMPLE | ANTI-TACK AGENT | FIXING DEVICE | TACKINESS | MISCIBILITY |
|---|---|---|---|---|---|---|
| 1 | FIXER 1 | Example 1 | dimethyl silicone oil | FIG. 1 | Almost None | Immiscible |
| 2 | | Example 2 | methyl phenyl silicone oil | FIG. 1 | Almost None | Immiscible |
| 3 | | Example 3 | canola oil | FIG. 1 | Almost None | Immiscible |
| 4 | | Example 4 | sesame oil | FIG. 1 | Almost None | Immiscible |
| 5 | | Example 5 | tridocosahexaenoin | FIG. 1 | Almost None | Immiscible |

-continued

| TEST NO. | FIXER | EXAMPLE | ANTI-TACK AGENT | FIXING DEVICE | TACKINESS | MISCIBILITY |
|---|---|---|---|---|---|---|
| 6 | | Example 6 | polyether-modified silicone oil with formula (2) | FIG. 1 | Almost None | Immiscible |
| 7 | | Comparative Example 1 | oleic acid | FIG. 1 | High | Miscible |
| 8 | | Comparative Example 2 | linoleic acid, | FIG. 1 | High | Miscible |
| 9 | | Control 1 | None | NA | High | NA |
| 10 | FIXER 2 | Example 7 | dimethyl silicone oil | FIG. 2 | Almost None | Immiscible |
| 11 | | Example 8 | canola oil | FIG. 2 | Almost None | Immiscible |
| 12 | | Example 9 | tridocosahexaenoin | FIG. 2 | Almost None | Immiscible |
| 13 | | Example 10 | polyether-modified silicone oil with formulas (2), (3), and (4) | FIG. 2 | Almost None | Immiscible |
| 14 | | Comparative Example 3 | oleic acid | FIG. 2 | Low | Dispersed |
| 15 | | Control 2 | None | None | High | NA |
| 16 | FIXER 3 | Example 11 | dimethyl silicone oil | FIG. 2 | Almost None | Immiscible |
| 17 | | Example 12 | canola oil | FIG. 2 | Almost None | Immiscible |
| 18 | | Example 13 | sesame oil | FIG. 2 | Almost None | Immiscible |
| 19 | | Comparative Example 4 | oleic acid | FIG. 2 | High | Miscible |
| 20 | | Control 3 | None | None | High | NA |

TABLE 2

| TEST NO. | ANTI-TACK AGENT | TACKINESS | FILM UNIFORMITY |
|---|---|---|---|
| 1 | dimethyl silicone oil | Almost None | Non-Uniform |
| 2 | methyl phenyl silicone oil | Almost None | Non-Uniform |
| 3 | canola oil | Almost None | Non-Uniform |
| 4 | sesame oil | Almost None | Non-Uniform |
| 5 | tridocosahexaenoin | Almost None | Non-Uniform |
| 6 | polyether-modified silicone oil with formula (2) | Almost None | Uniform |
| 13 | polyether-modified silicone oil with formulas (2), (3), and (4) | Almost None | Uniform |

Example 14

Figure 9:
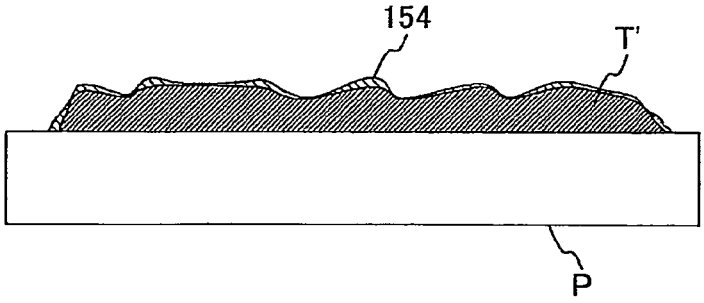
FIG. 9 is another diagram illustrating a profile in which an anti-tack agent is applied to a surface of a fixed toner image on a recording medium.

TABLE 2 illustrates results of the film uniformity evaluation of the anti-tack agent applied on the surface of the fixed toner image in the above Examples. The results show that a non-uniform film of the anti-tack agent, which exhibited the structure illustrated in FIG. 9, was observed in Examples corresponding to the test Nos. 1, 2, 3, 4, and 5, whereas a highly uniform film of the anti-tack agent, which exhibited the structure illustrated in FIG. 8, was observed in Examples corresponding to the test Nos. 6 and 13. All the samples used in Examples corresponding to the test Nos. illustrated in TABLE 2 exhibited an excellent initial tackiness preventing effect. An accelerated test was conducted as a long-term storage test by allowing the samples used in the test Nos. illustrated in TABLE 2 to stand at 80° C. for 10 days. The result show that tackiness was obtained and thus bleed-through was observed in the samples used in Examples corresponding to the test Nos. 1, 2, 3, 4, and 5, whereas the tackiness preventing effect after the accelerated test was maintained in the samples used in Examples corresponding to the test Nos. 6 and 13.

Example 15

TABLE 3

| TEST NO. | ANTI-TACK AGENT | HLB VALUE | MISCIBILITY | TACKINESS |
|---|---|---|---|---|
| 21 | X-22-2516 | 1 | Immiscible | Almost None |
| 22 | KF-945 | 4 | Immiscible | Almost None |
| 23 | KF-352A | 7 | Dispersed | Low |
| 24 | KF-615A | 10 | Miscible | High |
| 25 | KF-351A | 12 | Miscible | High |

TABLE 3 illustrates tackiness results obtained by applying different anti-tack agents having different HLB values on the toner image fixed with the fixer 2 and miscibility of the anti-tack agents with dicarbitol succinate used in the fixer 2 as a softener. If the HLB value of the anti-tack agent was 7 or more, the anti-tack agent exhibited immiscibility with the softener, thereby preventing tackiness.

As illustrated in TABLE 3, the tackiness preventing effect was obtained when a material that was immiscible with the fixer was used as the anti-tack agent. However, the tackiness preventing effect was not obtained when a material that was miscible with the fixer was used as the anti-tack agent. Thus, the material that was miscible with the fixer was not suitable for the anti-tack agent. As can be clear from Comparative Example 3, if the softener and the anti-tack agent were dispersed, the tackiness was slightly lowered compared to a case where no anti-tack agent was applied; however, insufficient tackiness preventing effect was obtained. Note that the applicants of the present application have proposed a tackiness preventing technology in the related art, where tackiness is prevented by covering an image surface having tackiness with an anti-blocking agent (AB agent) that was not softened with a softener in fixer. However, the AB agent used in the related art is a solid material examples of which include silicon carbide, aluminium oxide, zirconium oxide, titanium oxide, zinc oxide, iron oxide, fluorocarbon resin, silicone rubber, polyethylene terephthalate resin, polyacetal resin, polyethylene, polypropylene, polycarbonate, polyphenylether, polyether ether ketone, chromium oxide, and cobalt. In the related art technology, since the image surface is covered with the above material, a color tone or texture is hence changed, which may lower image quality and printing quality. Accordingly, it is preferable to use tackiness preventing technology described in the above embodiments.

In the above embodiments, the anti-tack agent application unit applies the liquid anti-tack agent immiscible with the softener to the surfaces of the resin particles that are mixed with the softener, such that the surface of the image formed with the developer containing resin particles is covered with the anti-tack agent. In this method, since other recording paper or objects are not directly in contact with the fixed image formed on the recording paper, the bleed-through or strike-through, or missing images due to tackiness may be prevented.

The descriptions of exemplary embodiments for implementing the invention have been provided heretofore. The present invention is not limited to these embodiments, but various variations and modifications may be made without departing from the scope of the present invention.

The present application is based on Japanese Priority Application No. 2010-047938 filed on Mar. 4, 2010, and Japanese Priority Application No. 2010-238727 filed on Oct. 25, 2010, with the Japanese Patent Office, the entire contents of which are hereby incorporated by reference.

What is claimed is:

1. A fixing device comprising:

a fixer application unit configured to apply a fixer containing a softener, capable of softening resin by dissolving or swelling at least a part of the resin, and water to resin particles formed on a recording medium such that the resin particles are fixed on the recording medium; and an anti-tack agent application unit configured to apply a liquid anti-tack agent immiscible with the softener to surfaces of the resin particles that are mixed with the softener by the application of the fixer containing the softener, wherein the liquid anti-tack agent is a silicone oil that includes at least one polyether group on a side chain thereof, the side chain being an organic group, and wherein the silicone oil is represented by a formula (1)

(1)

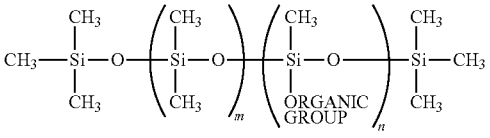

where "m" is an integer and "n" is an integer, and wherein the polyether group on the side chain thereof is represented by a formula (2), $$—R(C_2H_4O)_a(C_3H_6O)_bR' \quad (2)$$

where "R" and "R'" represent organic groups and where "a" is an integer and "b" is an integer.

2. The fixing device as claimed in claim 1, wherein the silicone oil having the at least one polyether group on the side chain thereof includes a HLB value of 7 or below.

3. The fixing device as claimed in claim 1, wherein the liquid anti-tack agent is a triglyceride.

4. An image forming apparatus comprising:

a latent image forming unit configured to form a latent image on a latent image carrier;

an image forming unit configured to develop the latent image formed on the latent image carrier using a developer containing resin particles to form an image composed of the resin particles on the latent image carrier;

a transferring unit configured to transfer the image composed of the resin particles formed on the latent image carrier to a recording medium;

a fixer application unit configured to apply a fixer containing a softener, capable of softening resin by dissolving or swelling at least a part of the resin, and water to the resin particles of the image formed on the recording medium; and an anti-tack agent application unit configured to apply a liquid anti-tack agent immiscible with the softener to surfaces of the resin particles that are mixed with the softener by the application of the fixer containing the softener, wherein the liquid anti-tack agent is a silicone oil that includes at least one polyether group on a side chain thereof, the side chain being an organic group, and wherein the silicone oil is represented by a formula (1)

(1)

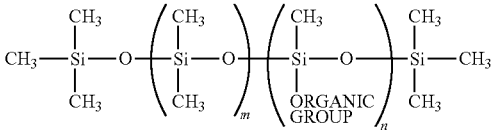

where "m" is an integer and "n" is an integer, and wherein the polyether group on the side chain thereof is represented by a formula (2), $$—R(C_2H_4O)a(C_3H_6O)_bR' \quad (2)$$

where "R" and "R'" represent organic groups and where "a" is an integer and "b" an integer.

* * * * *